US006999048B2

(12) United States Patent
Sun et al.

(10) Patent No.: US 6,999,048 B2
(45) Date of Patent: Feb. 14, 2006

(54) INTEGRATED DATA DRIVER STRUCTURE USED IN A CURRENT-DRIVING DISPLAY DEVICE

(75) Inventors: Wein-Town Sun, Kao-Hsiung (TW); Chien-Chih Chen, Hsin-Chu Hsien (TW)

(73) Assignee: AU Optronics Corp., Hsin-Chu (TW)

( * ) Notice: Subject to any disclaimer, the term of this patent is extended or adjusted under 35 U.S.C. 154(b) by 268 days.

(21) Appl. No.: 10/463,585

(22) Filed: Jun. 18, 2003

(65) Prior Publication Data

US 2004/0174282 A1 Sep. 9, 2004

(30) Foreign Application Priority Data

Mar. 7, 2003 (TW) ..... 92105008 A

(51) Int. Cl.
*G09G 3/32* (2006.01)

(52) U.S. Cl. ..... 345/82

(58) Field of Classification Search ..... 345/82, 345/83, 30, 55, 93, 103
See application file for complete search history.

(56) References Cited

*Primary Examiner*—Sumati Lefkowitz
*Assistant Examiner*—Tammy Pham
(74) *Attorney, Agent, or Firm*—Winston Hsu

(57) ABSTRACT

An integrated data driver used in a current-driving display device includes a digital-to-analog current converter for transforming a digital signal into an analog current signal, and a plurality of sets of data driving circuits for driving a plurality of corresponding data lines. Each set of data driving circuits includes a current-copying/reproducing module and a control circuit. The current-copying/reproducing module is used to store a predetermined voltage for conducting the analog current signal in a transforming/storing status and to conduct a reproducing current signal, which is generated by the predetermined voltage, to the corresponding data line in a reproducing/sustaining status. The control circuit is electrically connected between the digital-to-analog current converter and the current-copying/reproducing module for providing a switch between the transforming/storing status and the reproducing/sustaining status.

17 Claims, 7 Drawing Sheets

INTEGRATED DATA DRIVER STRUCTURE USED IN A CURRENT-DRIVING DISPLAY DEVICE

BACKGROUND OF INVENTION

1. Field of the Invention

The invention relates to an integrated data driver structure used in a current-driving display device, and more particularly, to a current-storing/reproducing integrated data driver structure including a digital-to-analog current converter and a plurality of grades of data drivers.

2. Description of the Prior Art

An OLED is an electrically driven lighting element having a brightness that depends on the magnitude of a related current. At present, the magnitude of the brightness (which is also called the gray-scale value) is controlled by the magnitude of the OLED driving current in an application OLED matrix display. Base upon the driving method, the matrix display can be classified as either a passive matrix or an active matrix display. Passive matrix displays adopt the method of driving the scan lines of the display in sequence, driving pixels in different rows sequentially. Since the light-emitting time of each pixel is restricted by the scanning frequency and the numbers of scan lines, the passive matrix method is not suitable for large-sized and high dots-per-inch (dpi) displays. Active matrix displays, however, possess an independent pixel circuit for each pixel, which is described in FIG. 1, which is a schematic diagram of a pixel 20. The present embodiment of the pixel 20 includes a capacitor C1, an OLED D, and a plurality of MOS transistors or TFTs (Thin-film Transistors) T1–T4. With this arrangement, even in large-sized and high dpi displays, a steady driving current I is provided for each pixel, which improves the brightness balance.

For achieving advantages of power saving, integrity, and cost effectiveness, more OLED systems adopt the digital type as an input data type so that the digital-to-analog converter should be involved in the data driver. In addition, the brightness of the OLED display is controlled by current. Therefore, the digital-to-analog process should be achieved by a digital-to-analog current converting circuit to convert digital data into an analog current signal. The corresponding pixel is also a current-driving pixel as the pixel 20 as shown in FIG. 1. Please refer to FIG. 2, which is a functional block diagram of a prior-art data driver structure 11. The data driver structure 11 corresponds to a plurality of matrix-arranged pixels 20 of a display device, and each of the pixels 20 is shown in FIG. 1. A plurality of scan lines 21 corresponding to the plurality of pixels 20 are included in the embodiment shown in FIG. 2. The data driver structure 11 includes a shift register 16 and a plurality of grades of data drivers 10. Each grade of data driver 10 includes a level shifter 12, a latch 14, and a digital-to-analog current converter 18. In a period of time there is at least a grade of data driver being operated to receive a digital signal. The level shifter 12 of the grade of data driver 10 adjusts potential levels of the digital signal (6-bit digital signal). The latch 14 is electrically connected to the level shifter for executing level-shifting and buffering functions. The latch 14 can be used to latch the 6-bit digital signal. The shift register 16 can be used to generate a shift-register signal to transmit the digital signal to the level shifter 12 at one time. Afterwards, the digital signal will be transmitted to the latch 14.

Please continue to refer to FIG. 2, the digital-to-analog current converter 18 of the operated grade of data driver 10 can be used to receive the digital signal and to transform the digital data into an analog current signal. The analog current signal will then be applied to a corresponding data line 19. The data line 19 is coupled to a plurality of pixels 20. In the meanwhile, there is a scan line 21 being operated (at a high potential level) to turn on the pixels 20 connected to the scan line 21. Therefore, the digital-to-analog current converter 18 will be connected to the data line 19 and the corresponding pixel 20, and the digital-to-analog current converter 18 will be used to conduct the analog current signal to the corresponding pixel 20. The grade of data driver 10 can be used to control the gray-scale quality of the display panel according to the magnitude of the analog current signal.

J. Kanicki et.al. (U. of Michigan, USA) has disclosed a simple digital-to-analog current converter installed with a set of TFTs (Thin Film Transistors) with a width-to-length ratio assigned as 1:2:4:8 and a current source to generate 16 current gray scales. Please refer to FIG. 3, which is a schematic diagram of an embodiment of a prior-art digital-to-analog current converter 18. The digital-to-analog current converter 18 is composed of a plurality of transistors T5–T9. Due to that the 16 current gray scales rely on 4 (1:2:4:8) TFTs T6–T9, any fluctuation of threshold potential level and mobility in each TFT will generate significant variation to affect the current gray scales. Furthermore, the quality of the corresponding panel will be influenced. In addition, because the output impedance of the digital-to-analog current converter 18 is not high enough, the output potential level will be affected by a current flow passing the digital-to-analog current converter 18. Therefore, when the digital-to-analog current converter 18 is connected to the corresponding pixel, the output current may not be a stable 16 gray-scale current.

SUMMARY OF INVENTION

It is therefore a primary objective of the claimed invention to provide a current storing/reproducing integrated data driver structure that includes a digital-to-analog current converter and a plurality of grades of data drivers, and each grade of data driver includes a current storing/reproducing module to conduct a stable duplicate current signal in a reproducing/sustaining status to solve the above-mentioned problems.

According to the claimed invention, an integrated data driver structure used in a current-driving display device for receiving a digital signal is disclosed. The integrated data driver structure comprises at least a digital-to-analog current converter for transforming the digital signal into an analog current signal; and a plurality of grades of data drivers electrically connected to the digital-to-analog current converter for driving a plurality of data lines of the display device, each grade of data driver comprising a current storing/reproducing module for storing a predetermined voltage required for conducting the analog current signal in a transforming/storing status, and for conducting a duplicate current signal to the data line in a reproducing/sustaining status, wherein the duplicate current signal is almost equal to the analog current signal; and a control circuit electrically connected between the digital-to-analog current converter and the current storing/reproducing module for switching the grade of data driver between the transforming/storing status and the reproducing/sustaining status.

According to the claimed invention, an integrated data driver structure used in a current-driving display device for receiving a digital signal is disclosed. The integrated data driver structure comprises at least a level shifter for adjusting voltage levels of the digital signal; a current-steering digital-to-analog current converter electrically connected to the level shifter for transforming the digital signal into an analog current signal; and a plurality of grades of data drivers electrically connected to the digital-to-analog current converter for driving a plurality of data lines of the display device, each grade of data driver comprising a current storing/reproducing module for storing a predetermined voltage required for conducting the analog current signal in a transforming/storing status, and for conducting a duplicate current signal to a corresponding data line in a reproducing/sustaining status, wherein the duplicate current signal is generated by the predetermined voltage, and the duplicate current signal is almost equal to the analog current signal; and a control circuit electrically connected between the digital-to-analog current converter and the current storing/reproducing module for switching the grade of data driver between the transforming/storing status and the reproducing/sustaining status.

These and other objectives of the present invention will no doubt become obvious to those of ordinary skill in the art after reading the following detailed description of the preferred embodiment, which is illustrated in the various figures and drawings.

DETAILED DESCRIPTION

Figure 1:
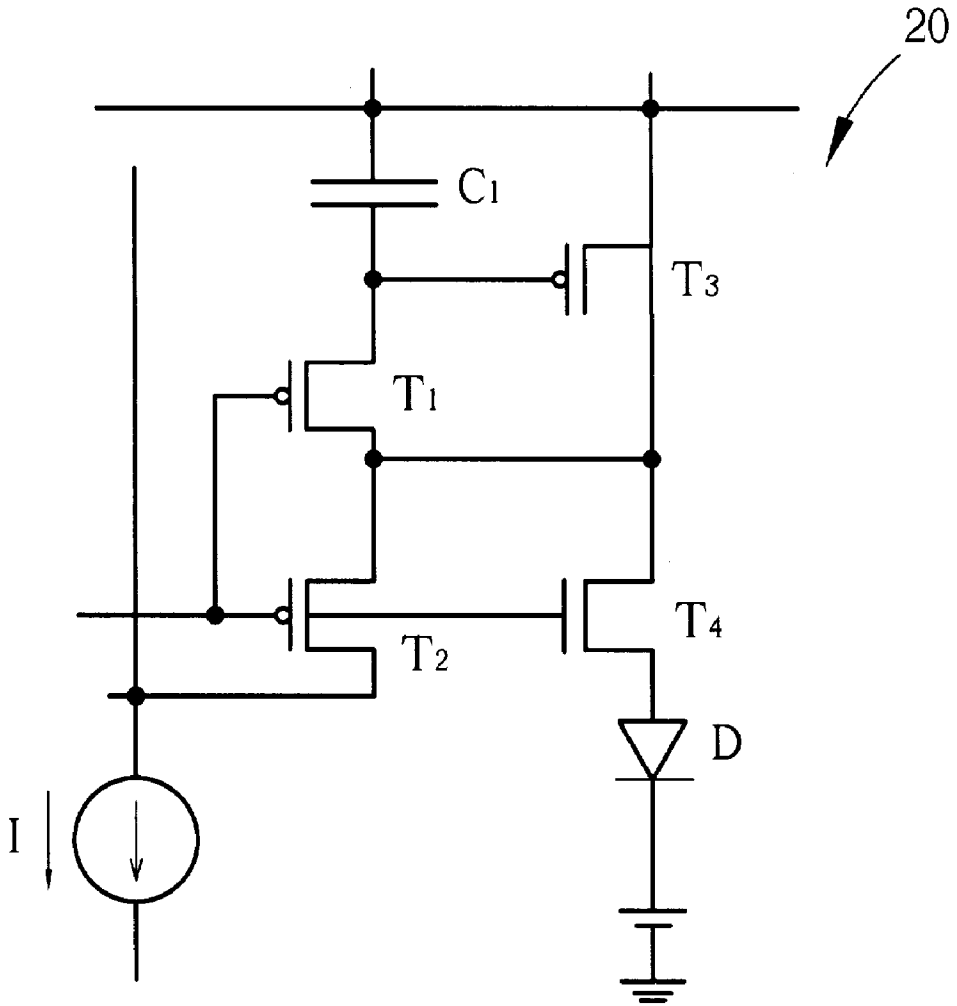
Fig. 1 Prior Art
FIG. 1 is a schematic diagram of a pixel according to the prior art.
Figure 2:
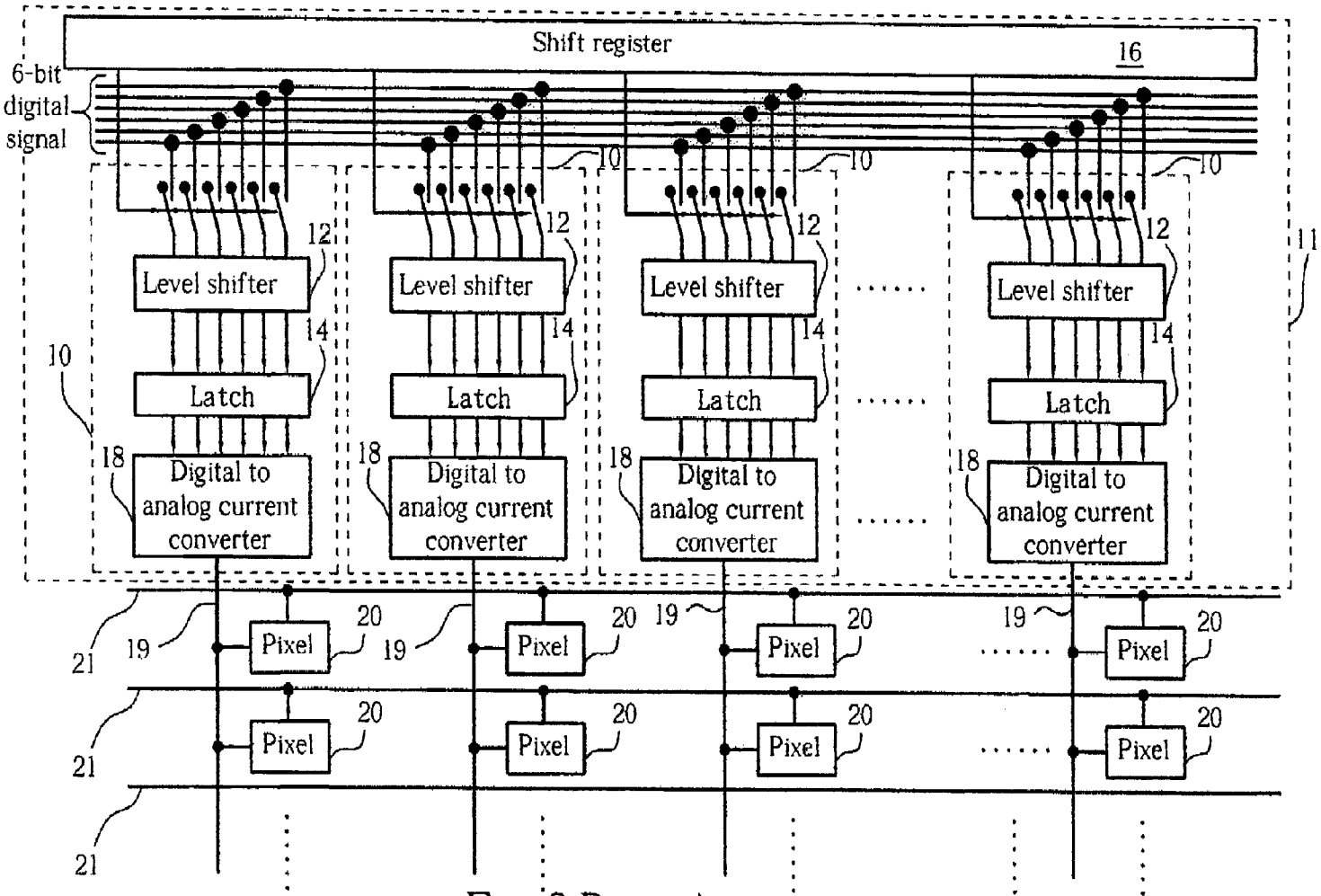
Fig. 2 Prior Art
FIG. 2 is a functional block diagram of a data driver structure according to the prior art.
Figure 3:
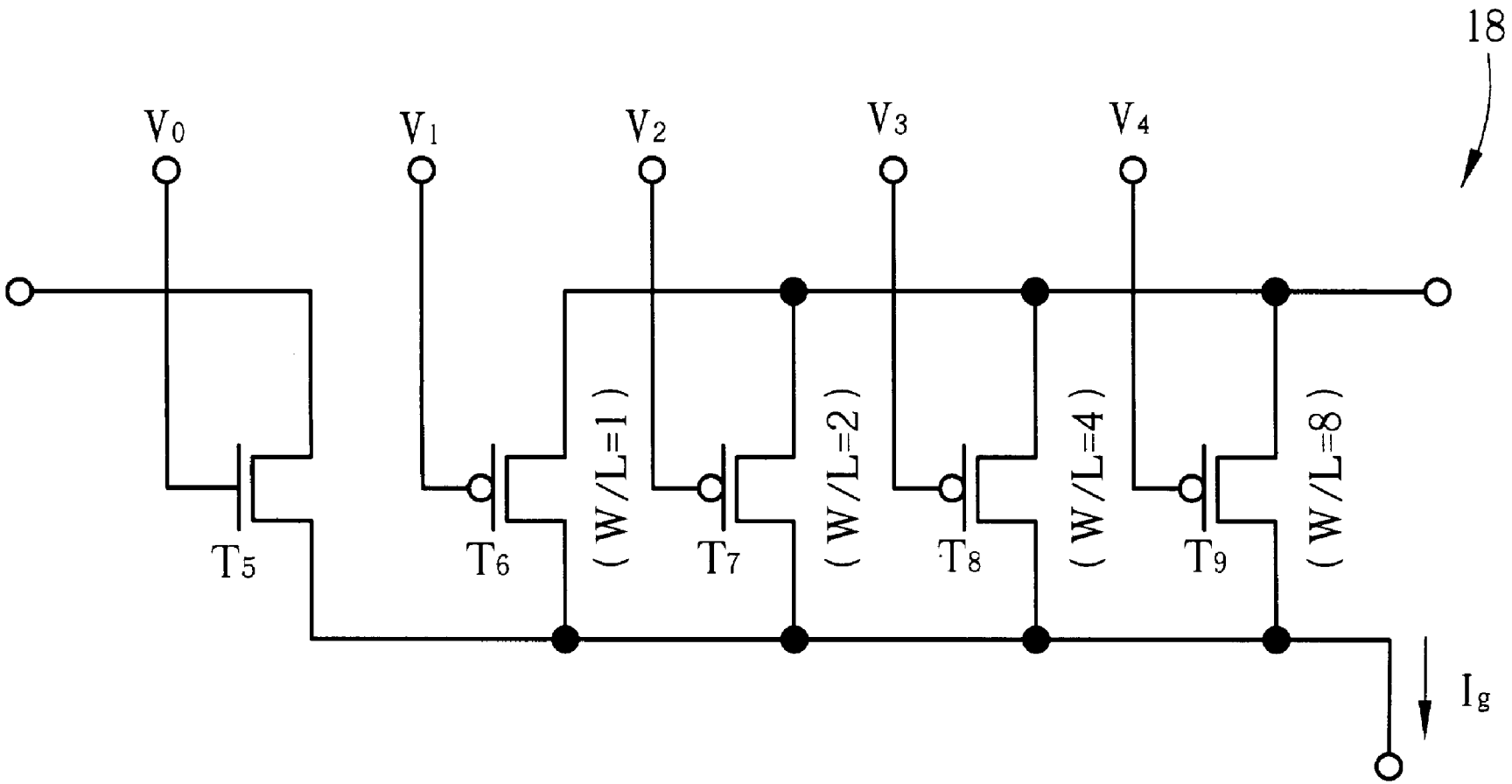
Fig. 3 Prior Art
FIG. 3 is a schematic diagram of an embodiment of a prior-art digital-to-analog current converter as shown in FIG. 2.
Figure 4:
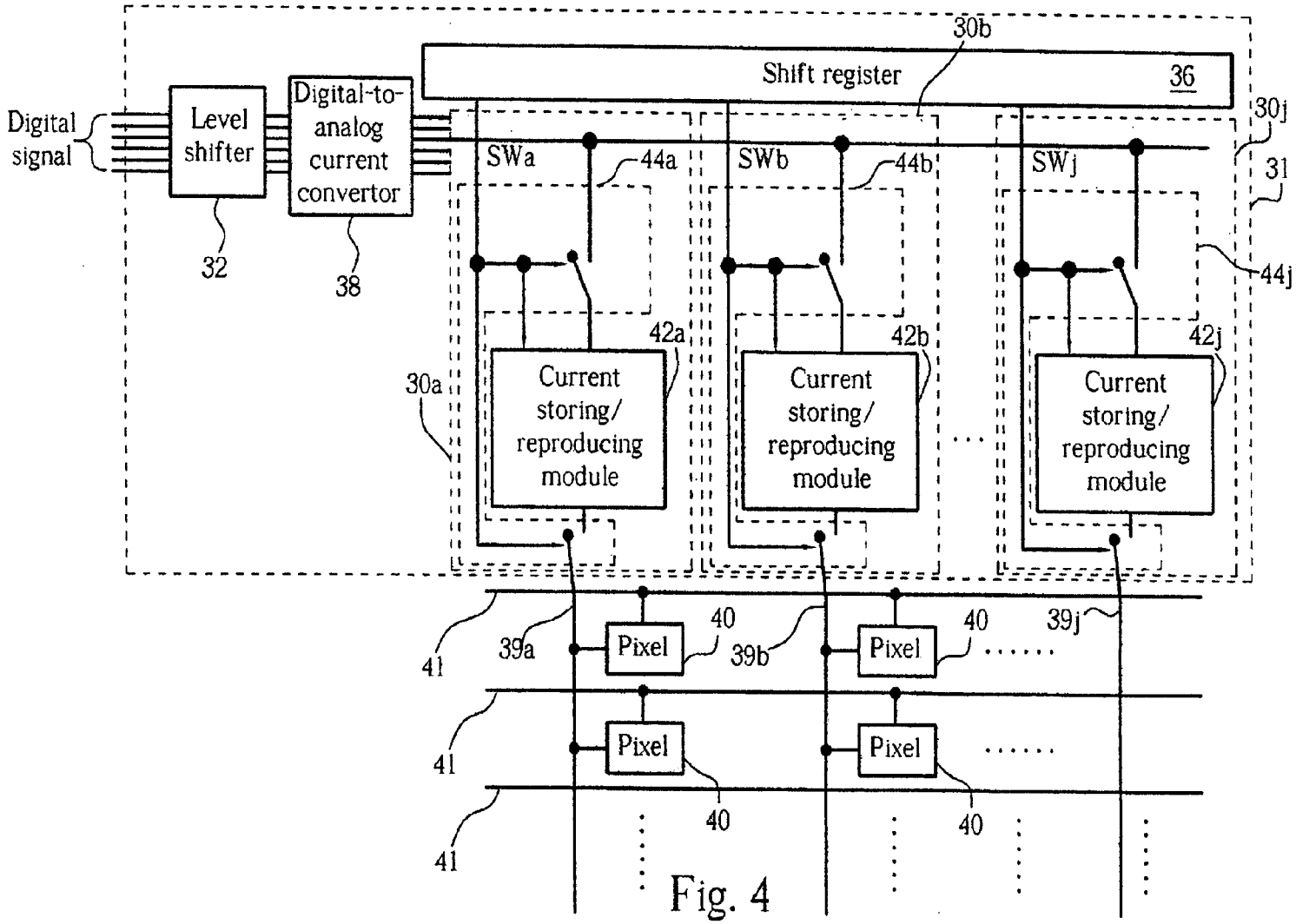
FIG. 4 is a functional block diagram of an integrated data driver structure according to the present invention.

Please refer to FIG. 4, which is a functional block diagram of an integrated data driver structure 31 according to the present invention. The integrated data driver structure 31 is applied in a current-driving display device. The pluralities of pixels 40 are arranged in a matrix form. The integrated data driver structure 31 includes a level shifter 32, a digital-to-analog current converter 38, and a plurality of grades of data drivers 30*a*, 30*b*–30*j*. The level shifter 32 can be used to adjust potential levels of the digital signal. The digital-to-analog current converter 38 is electrically connected to the level shifter 32 for transforming the digital signal into an analog current signal. The plurality of grades of data drivers 30*a*, 30*b*–30*j* are electrically connected to the digital-to-analog current converter 38, and the plurality of grades of data drivers 30*a*, 30*b*–30*j* share the same digital-to-analog current converter 38 (and the level shifter 32). The plurality of grades of data drivers 30*a*, 30*b*–30*j* are used to drive a plurality of data lines 39*a*, 39*b*–39*j* of the display device, wherein the plurality of data lines 39*a*, 39*b*–39*j* respectively correspond to the plurality of grades of data drivers 30*a*, 30*b*–30*j*). Each of the plurality of grades of data drivers 30*a*, 30*b*–30*j* includes a current storing/reproducing module (42*a*, 42*b*–42*j*) and a control circuit (44*a*, 44*b*–44*j*). The current storing/reproducing module (42*a*, 42*b*–42*j*) is used to store a predetermined voltage required for conducting the analog current signal a predetermined voltage, and to conduct a duplicate current signal to a corresponding data line (39*a*, 39*b*–39*j*) of the current storing/reproducing module (42*a*, 42*b*–42*j*) in a reproducing/sustaining status. The duplicate current signal is generated by the predetermined voltage, and the duplicate current signal is almost equal to the analog current signal. The control circuit (44*a*, 44*b*–44*j*) is electrically connected between the digital-to-analog current converter 38 and current storing/reproducing module (42*a*, 42*b*–42*j*) for switching the corresponding grade of data driver (30*a*, 30*b*–30*j*) between the transforming/storing status and the reproducing/sustaining status.

When being implemented, the quantity of the level shifter 32 (or latch) should not be limited. The integrated data driver structure 31 as shown in FIG. 4 further includes a shift register 36, which can be used to generate a plurality of switch signals SWa, SWb–SWj corresponding to the plurality of grades of data drivers 30*a*, 30*b*–30*j*. The above-mentioned switch operation between the transforming/storing status and the reproducing/sustaining status is achieved by the control circuit (44*a*, 44*b*–44*j*) combined with the corresponding switch signal (SWa, SWb–SWj) in the corresponding grade of data driver (30*a*, 30*b*–30*j*). When being implemented, the plurality of switch signals SWa, SWb–SWj can be generated either by the shift register 36 or by a plurality of shift registers 36. Therefore, the quantity of the shift register 36 should not be limited. Actually, the plurality of switch signals SWa, SWb–SWj can even be generated by other control module. Please refer to FIG. 5, which is a schematic diagram of a detailed embodiment of the integrated data driver structure 31 as shown in FIG. 4. The present invention emphasizes the combination between the digital-to-analog current converter 38 and the plurality of grades of data drivers 30*a*, 30*b*–30*j* (each grade of data driver (30*a*, 30*b*–30*j*) includes a current storing/reproducing module (42*a*, 42*b*–42*j*) and a control circuit (44*a*, 44*b*–44*j*)). A plurality of corresponding data lines 39*a*, 39*b*–39*j*, are included in FIG. 5. Please notice that the present embodiment describes the conditions in the transforming/storing status. The digital-to-analog current converter 38 is a current-steering digital-to-analog current converter 38 with greater output impedance for preventing the fluctuation of an output voltage by any current flow passing the digital-to-analog current converter 38. Each the control circuit (44*a*, 44*b*–44*j*) is electrically connected between the digital-to-analog current converter 38 and corresponding current storing/reproducing module (42*a*, 42*b*–42*j*), and is composed of two transistors T10, T11 for receiving a switch signal SWa, SWb–SWj. Each current storing/reproducing module (42*a*, 42*b*–42*j*) includes a capacitor C and a plurality of MOS (Metal-Oxide Semiconductor, MOS) transistors (or a plurality of TFTs), wherein the capacitor C can be used to store a predetermined voltage required for conducting the analog current signal. Provided with proper voltage sources (Vdd, Vbias), current sources (i, $2i-2^{N-1}i$), input data (D0, D1–DN−1), and ground level, the integrated data driver structure 31 can operate well.

Figure 5:
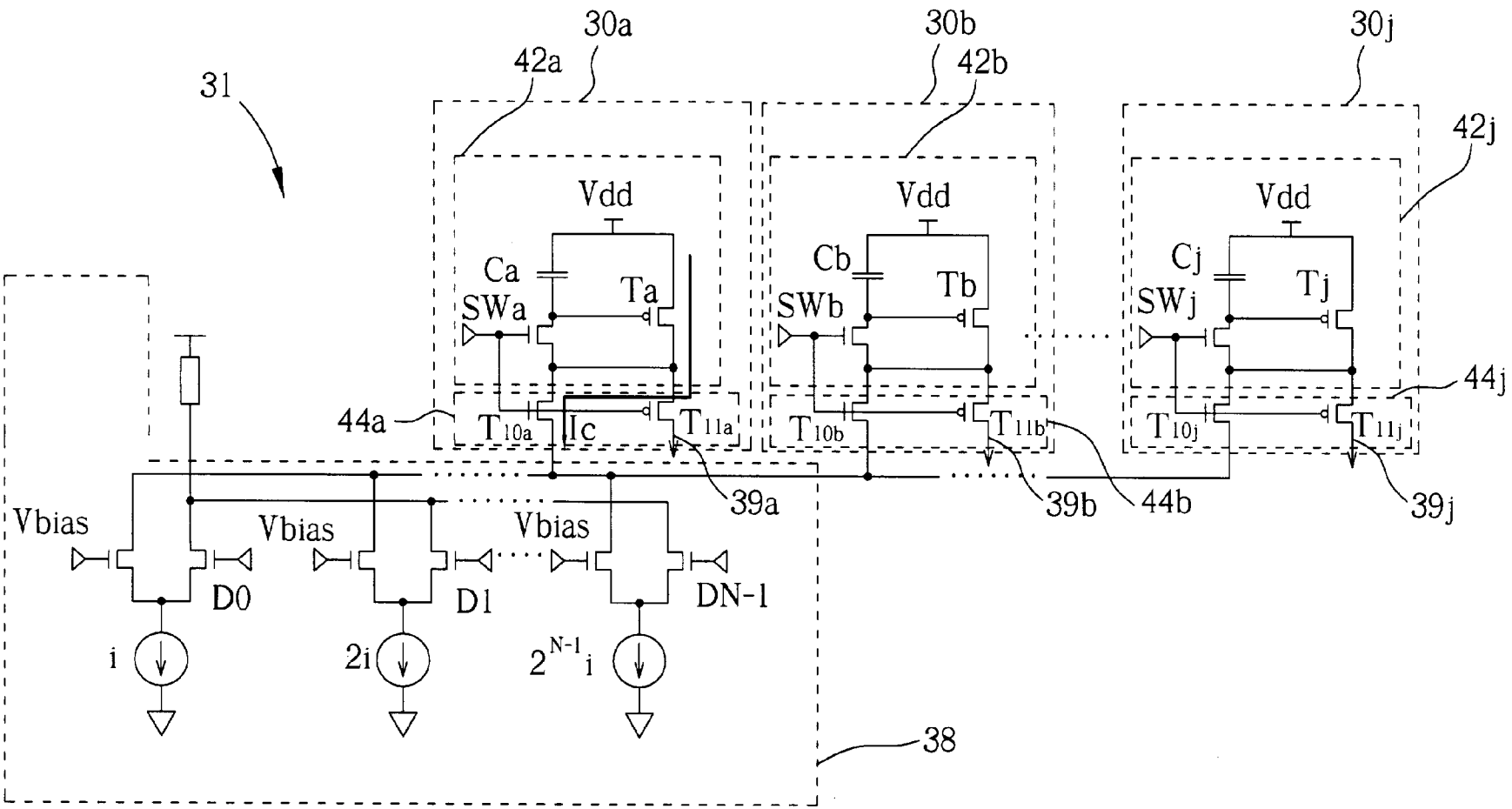
FIG. 5 is a schematic diagram of a detailed embodiment of the integrated data driver structure in a transforming/storing status.

Please continue to refer to FIG. 5. Taking a grade of data driver 30*a* for instance, when the corresponding switch signal Swa received by the control circuit 44*a* is at a high potential level, the grade of data driver 30*a* is in the transforming/storing status. The digital signal will be transformed into the analog current signal by the processing of the digital-to-analog current converter 38. In the transforming/storing status, due to that the switch signal Swa is at the high potential level, a transistor T11*a* of the control circuit 44*a* is turned off, and the control circuit 44*a* will disconnect the route to the data line 39*a*. The transistor T10*a* will be turned on, the route between the digital-to-analog current converter 38 and the current storing/reproducing module 42*a* is formed. The analog current signal will be conducted to the current storing/reproducing module 42*a*. In the meanwhile, the analog current signal will pass through a PMOS transistor Ta and the capacitor Ca to make the capacitor Ca store the predetermined voltage required for conducting the analog current signal. Therefore, in the present embodiment, the predetermined voltage is a drain-to-source voltage drop (Vgs) of the PMOS transistor Ta. Please notice that the current storing/reproducing module 42*a* can be a MOS transistor or a TFT. Actually, the type of transistor Ta should not be limited, and the combination among the transistor Ta and the capacitor Ca is flexible. With different circuit combinations, the design of potential level of the switch signal SWa can be adjusted. In addition, all the other data drivers 30*b*–30*j* apply the same above-mentioned characteristics.

When the switch signal Swa is at a low potential level, the grade of data driver 30*a* is in the reproducing/sustaining status. A next grade of data driver 30*b* as shown in FIG. 5 should be used to receive a corresponding high-potential-level switch signal SWb to make the data driver 30*b* stay in the transforming/storing status. Please refer to FIG. 6, which is a schematic diagram of another detailed embodiment of the integrated data driver structure 31 as shown in FIG. 4 in the reproducing/sustaining status. Referring to both FIG. 5 and FIG. 6, the transforming/storing status is sequentially present in the plurality of grades of data drivers 30*a*, 30*b*–30*j*. Similarly, the reproducing/sustaining status is also sequentially present in the plurality of grades of data drivers 30*a*, 30*b*–30*j*. For each grade of data driver (30*a*, 30*b*–30*j*), the transforming/storing status and the reproducing/sustaining status take place by turns. After the switch signal Swa turns to the low potential level from the high potential level, the control circuit 44*a* (the switch signal Swa is used to turn off the transistor T10*a*) is used to disconnect the route between the digital-to-analog current converter 38 and the current storing/reproducing module 42*a*. In the meanwhile, the transistor T11*a* is turned on, the current storing/reproducing module 42*a* will be used to conduct a duplicate current signal Io to the data line 39*a* and the corresponding pixel 40 in the reproducing/sustaining status. The duplicate current signal is generated by the predetermined voltage previously stored in the current storing/reproducing module 42*a* in the transforming/storing status. Due to that the predetermined voltage is required to conduct the analog current signal, the duplicate current signal is almost equal to the analog current signal generated by the digital-to-analog current converter 38.

Figure 6:
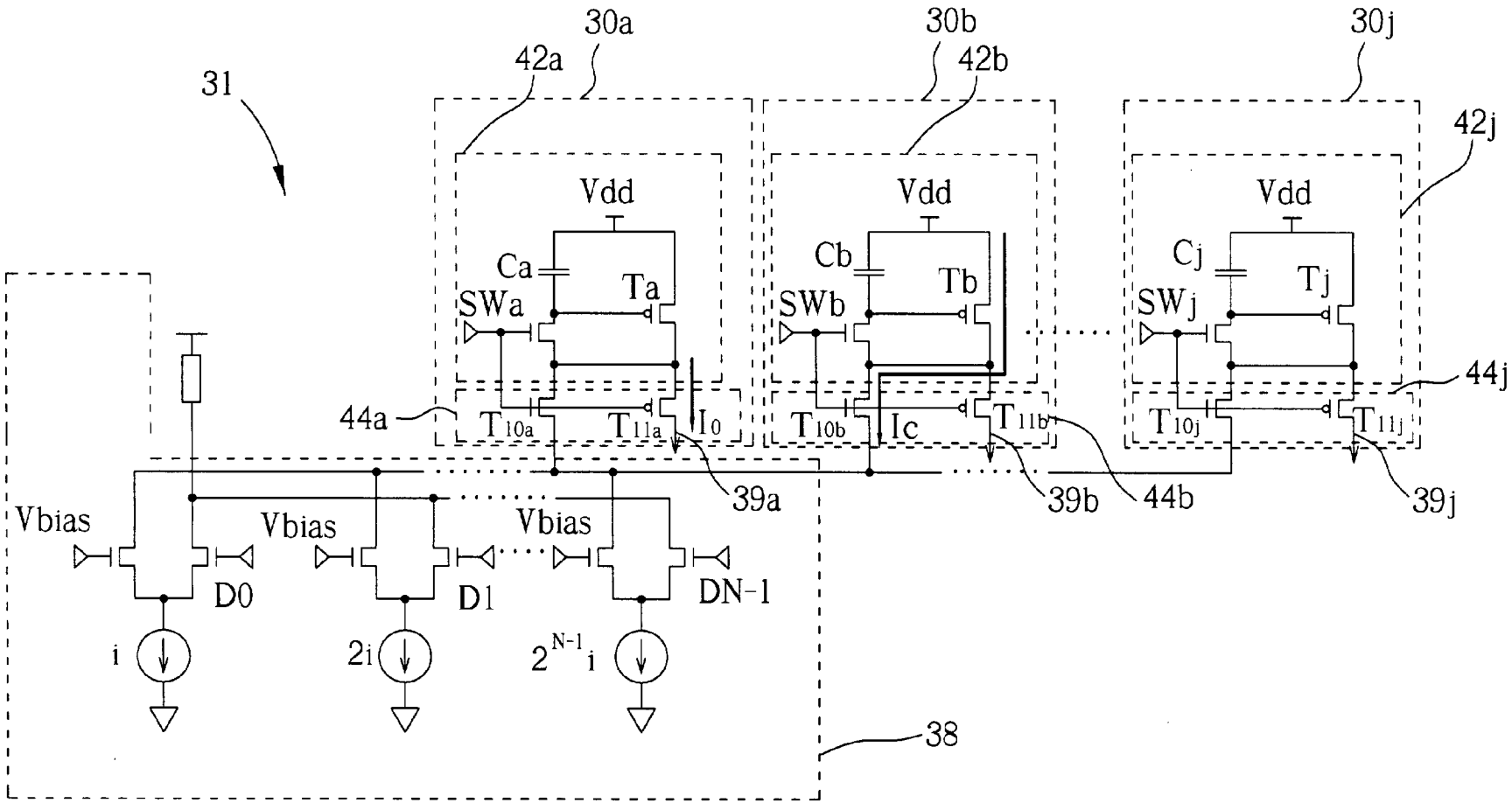
FIG. 6 is a schematic diagram of a detailed embodiment of the integrated data driver structure in a reproducing/sustaining status.
Figure 7:
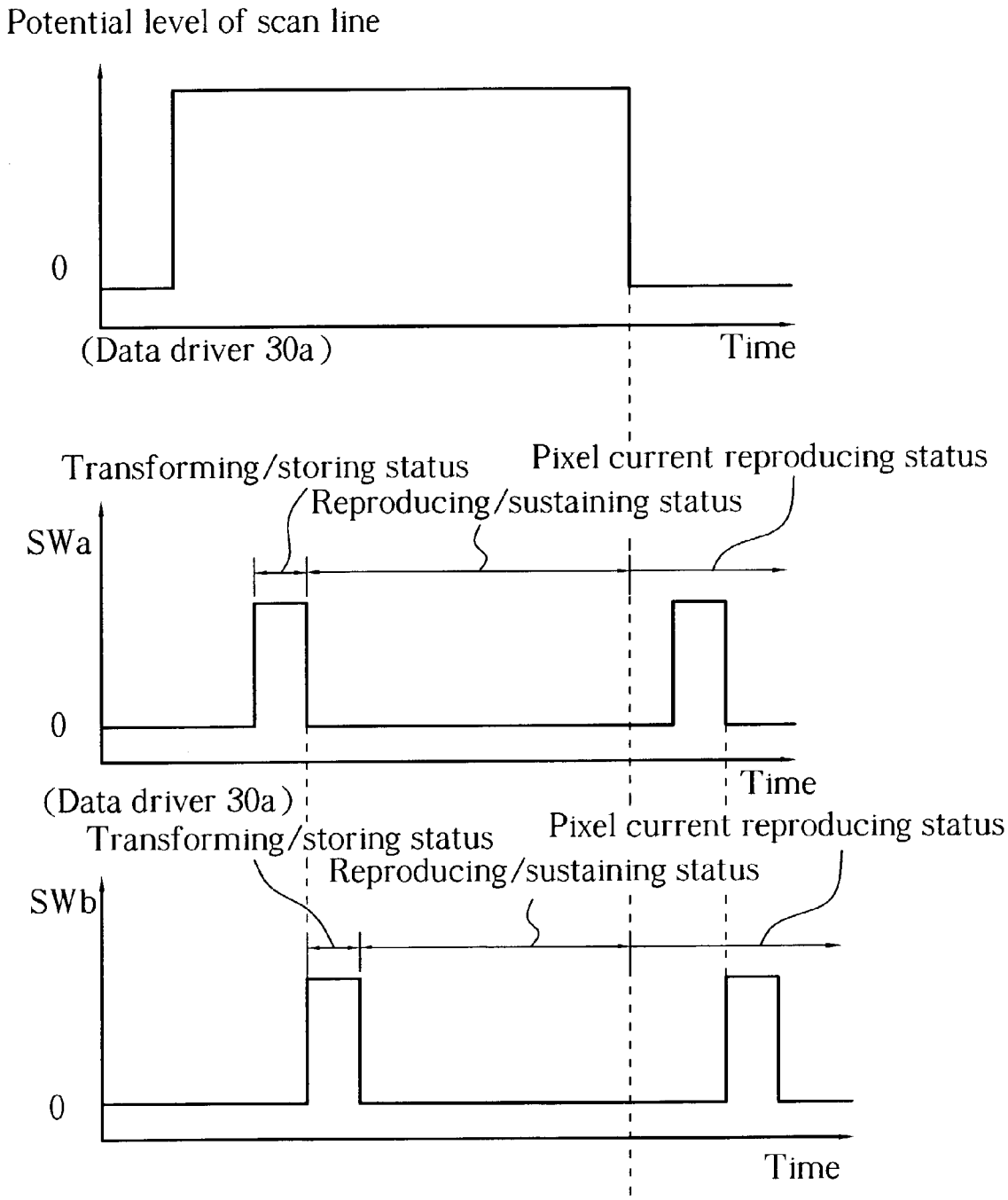
FIG. 7 is a timing diagram showing operations of embodiments shown in FIG. 5 and FIG. 6 according to the present invention.

Please refer to both FIG. 4 and FIG. 6. When a grade of data driver (30*a*, 30*b*–30*j*) disconnects the route to the digital-to-analog current converter 38 and connect the route to a corresponding data line (39*a*, 39*b*–39*j*), there should be a scan line 41 starting being operated to turn on the related pixels 40 coupled to the scan line 41. For instance, in the grade of data driver 30*a*, the transistor Ta will be connected to the data line 39*a* and the corresponding pixel 40. Therefore, there is at least a pixel 40 that will be injected with a current signal from the current storing/reproducing module 42*a*, and the injected current signal is almost equal to the digital signal transformed from the analog current signal. When the scan line 41 is turned off (at the low potential level), due to that the pixel 40 is a current storing/reproducing pixel 40, the pixel 40 will reproduce a duplicate current whose magnitude is almost equal to the previously injected current signal to conduct the duplicate current to a OLED or a PLED of the pixel 40. Please refer to FIG. 7, which shows operations of the above-mentioned embodiments shown in FIG. 4 to FIG. 6. Two adjacent grades of data driver 30*a*, 30*b* shown in FIG. 5 and FIG. 6 are described in FIG. 7. From the embodiment in FIG. 7, we can emphasize that the transforming/storing status is sequentially present in the two grades of data drivers 30*a* and 30*b*, and the reproducing/sustaining status is also sequentially present in the two grades of data drivers 30*a*and 30*b*. For each grade of data driver (30*a*, 30*b*), the transforming/storing status and the reproducing/sustaining status take place by turns. In addition, the embodiment defines a period of time in which the scan line 41 is turned off as a pixel current reproducing status.

The integrated data driver structure of the present invention can be applied in an OLED display device, a PLED display device, and other current-driving display devices. The integrated data driver structure integrates a digital-to-analog current converter with a plurality of grades of data drivers to store a predetermined voltage in a transforming/storing status and to conduct a stable gray-scale current in a reproducing/sustaining status.

Those skilled in the art will readily observe that numerous modifications and alterations of the device and method may be made while retaining the teachings of the invention. Accordingly, the above disclosure should be construed as limited only by the metes and bounds of the appended claims.

What is claimed is:

1. An integrated data driver structure used in a current-driving display device for receiving a digital signal, the integrated data driver structure comprising:

at least a digital-to-analog current converter for transforming the digital signal into an analog current signal; and a plurality of grades of data drivers electrically connected to the digital-to-analog current converter for driving a plurality of data lines of the display device, each grade of data driver comprising:

a current storing/reproducing module for storing a predetermined voltage required for conducting the analog current signal in a transforming/storing status, and for conducting a duplicate current signal to the data line in a reproducing/sustaining status, wherein the duplicate current signal is almost equal to the analog current signal; and a control circuit electrically connected between the digital-to-analog current converter and the current storing/reproducing module for switching the grade of data driver between the transforming/storing status and the reproducing/sustaining status.

2. The integrated data driver structure of claim 1, wherein in the current storing/reproducing module of each grade of data driver, the duplicate current signal is generated by the predetermined voltage.

3. The integrated data driver structure of claim 1 further comprising at least a level shifter electrically connected to the digital-to-analog current converter for adjusting voltage levels of the digital signal.

4. The integrated data driver structure of claim 1 further comprising at least a shift register for outputting a plurality of switch signals to the plurality of control circuits, wherein each switch signal is used to switch the corresponding grade of data driver between the transforming/storing status and the reproducing/sustaining status.

5. The integrated data driver structure of claim 4, wherein if the switch signal is at a high potential level, the corresponding grade of data driver is in the transforming/storing status, and the control circuit connects the digital-to-analog current converter to the current storing/reproducing module to conduct the analog current signal generated by the digital-to-analog current converter to the current storing/reproducing module, which stores the predetermined voltage required for conducting the analog current signal.

6. The integrated data driver structure of claim 5, wherein the current storing/reproducing module comprises at least a capacitor and a plurality of MOS transistors or TFTs, and the predetermined voltage is a drain-to-source voltage drop (Vgs) of a transistor.

7. The integrated data driver structure of claim 4, wherein if the switch signal is at a low potential level, the corresponding grade of data driver is in the reproducing/sustaining status, and the control circuit will disconnect the route between the digital-to-analog current converter and the current storing/reproducing module and conduct the duplicate current signal to the corresponding data line.

8. The integrated data driver structure of claim 1, wherein the digital-to-analog current converter is a current-steering digital-to-analog current converter.

9. The integrated data driver structure of claim 1, wherein the display device is an OLED display device, a PLED display device, or another current-driving display device.

10. An integrated data driver structure used in a current-driving display device for receiving a digital signal, the integrated data driver structure comprising:

at least a level shifter for adjusting voltage levels of the digital signal;

a current-steering digital-to-analog current converter electrically connected to the level shifter for transforming the digital signal into an analog current signal; and a plurality of grades of data drivers electrically connected to the digital-to-analog current converter for driving a plurality of data lines of the display device, each grade of data driver comprising:

a current storing/reproducing module for storing a predetermined voltage required for conducting the analog current signal in a transforming/storing status, and for conducting a duplicate current signal to a corresponding data line in a reproducing/sustaining status, wherein the duplicate current signal is generated by the predetermined voltage, and the duplicate current signal is almost equal to the analog current signal; and a control circuit electrically connected between the digital-to-analog current converter and the current storing/reproducing module for switching the grade of data driver between the transforming/storing status and the reproducing/sustaining status.

11. The integrated data driver structure of claim 10 further comprising at least a shift register for outputting a plurality of switch signals to the plurality of control circuits, wherein each switch signal is used to switch the corresponding grade of data driver between the transforming/storing status and the reproducing/sustaining status.

12. The integrated data driver structure of claim 11, wherein if the switch signal is at a high potential level, the corresponding grade of data driver is in the transforming/storing status, and the control circuit connects the digital-to-analog current converter to the current storing/reproducing module to conduct the analog current signal generated by the digital-to-analog current converter to the current storing/reproducing module, which stores the predetermined voltage required for conducting the analog current signal.

13. The integrated data driver structure of claim 12, wherein the current storing/reproducing module comprises at least a capacitor and a plurality of MOS transistors or TFTs, and the predetermined voltage is a drain-to-source voltage drop (Vgs) of a transistor.

14. The integrated data driver structure of claim 11, wherein if the switch signal is at a low potential level, the corresponding grade of data driver is in the reproducing/sustaining status, and the control circuit will disconnect the route between the digital-to-analog current converter and the current storing/reproducing module and conduct the duplicate current signal to the corresponding data line.

15. The integrated data driver structure of claim 14, wherein each data line corresponds to a plurality of pixels, the plurality of pixels are arranged in a matrix form, and each pixel is a current storing/reproducing pixel.

16. The integrated data driver structure of claim 15, wherein the plurality of pixels correspond to a plurality of scan lines, wherein when the grade of data driver is in the reproducing/sustaining status, at least a scan line will operate the corresponding pixel so that the data line can conduct the duplicate current signal to the corresponding pixel.

17. The integrated data driver structure of claim 10, wherein the display device is an OLED display device, a PLED display device, or another current-driving display device.

* * * * *